United States Patent [19]

Taylor

[11] 4,330,302

[45] May 18, 1982

[54] HIGH THERMAL STABILITY LIQUID HYDROCARBONS AND METHODS FOR PRODUCING THEM

[75] Inventor: William F. Taylor, Mountainside, N.J.

[73] Assignee: Exxon Research & Engineering Co., Florham Park, N.J.

[21] Appl. No.: 608,659

[22] Filed: Aug. 28, 1975

Related U.S. Application Data

[62] Division of Ser. No. 417,723, Nov. 21, 1973, abandoned.

[51] Int. Cl.[3] ..... C10L 1/22; C10L 1/24; C10M 1/34; C10M 1/38

[52] U.S. Cl. ..... 44/63; 44/72; 252/401; 252/402; 252/405; 252/406; 252/45; 252/50

[58] Field of Search ..... 44/63, 72; 252/401, 252/402, 405, 406

[56] References Cited

U.S. PATENT DOCUMENTS

| | | | |
|---|---|---|---|
| 2,528,785 | 11/1950 | Richter et al. | 44/63 X |
| 2,864,676 | 12/1958 | Thompson | 44/63 |
| 3,147,210 | 9/1964 | Hass et al. | 208/143 |
| 3,328,289 | 6/1967 | Streed | 208/15 |
| 3,436,336 | 3/1969 | Ireland | 208/66 |
| 3,438,757 | 4/1969 | Honnen et al. | 44/63 X |
| 3,475,412 | 10/1969 | Peterli et al. | 44/63 X |
| 3,516,806 | 6/1970 | Malec | 252/401 X |
| 3,628,926 | 12/1971 | Eckert et al. | 44/63 |
| 3,898,056 | 8/1975 | Honnen | 44/63 X |

OTHER PUBLICATIONS

Nixon et al., *I & EC Product Research and Development,* vol. 5, No. 1, Mar. 1966, pp. 87–92.
Taylor et al., *I & EC Product Research and Development,* vol. 6, No. 4, Dec. 1967, pp. 258–262.
Hrubesch et al., CA 53: 22896–22897, (1958).
Scott et al., CA 51: 3969d, (1957).
Ivanov et al., CA 77: 21860k, (1972).
Harle et al., CA 55: 6840q, (1958).
Kalantar, CA 58: 11146b, (1963).
Chertkov et al., CA 56: 3723d, (1960).
Kröger, CA 44: 1685d, (1950).
Heinrich, CA 46: 8361g, (1952).

*Primary Examiner*—Thomas A. Waltz
*Attorney, Agent, or Firm*—Wayne Hoover; Eugene Zagarella, Jr.

[57] ABSTRACT

Liquid petroleum hydrocarbon blends having improved thermal stability at temperatures of 1000° F. and higher are prepared by removing from the blends dissolved molecular oxygen and maintaining low levels of certain trace impurities in the blends. Trace impurity compounds that are maintained at low levels include: sulfur compounds classed as thiols, sulfides, disulfides and polysulfides; organic oxygen compounds classed as hydroperoxides, peroxides, paraffinic carboxylic acids, and phenols; nitrogen compounds classed as amides and alkyl-pyridines; and reactive olefins. Additional improvements in the blends can be obtained by providing them with a dibenzothiophene or a nitrogen compound classed as a paraffinic amine, carbazole or piperidine. The treated blends of this invention have substantially the same physical properties as similar blends that have not been so treated.

18 Claims, No Drawings

HIGH THERMAL STABILITY LIQUID HYDROCARBONS AND METHODS FOR PRODUCING THEM

The invention herein described was made in the course of or under a contract, or subcontract thereunder, (or grant) with the Department of the Navy.

This is a division of application Ser. No. 417,723, filed Nov. 21, 1973, now abandoned.

BACKGROUND OF THE INVENTION

This invention relates to liquid hydrocarbons and methods for producing them and more particularly to high thermal stability liquid hydrocarbons and their methods of production.

As the Mach number of supersonic aircraft increases, the air-frame skin temperature and engine inlet temperature increase rapidly. The net result is that the fuel used to power the aircraft is exposed to greater and greater thermal stress as the speed of the aircraft increases. If the fuel fails under thermal stress the aircraft can be rendered inoperable in a variety of ways. For example, degraded fuel can form deposits and sediments which can markedly lower heat transfer coefficients in key areas and/or plug narrow tolerance parts and filters. For a high speed airplane operating at mach 4.5, ram air temperatures are in the range of 1400° F. In such situations, the fuel is the only material present which can be used as a heat sink for cooling.

Present day aircraft turbine engine fuel does not possess the thermal stability necessary to satisfy the requirements of a Mach 4 to 5 aircraft. In the past, a number of proposals have been made for providing a high thermal stability jet fuel, but these proposals each have drawbacks. For example, it has been proposed to use specialty fuels such as methylcyclohexane, but these fuels are extremely high in cost and are not readily available. Also, it has been proposed to use cryogenic fuels, but such fuels are impractical because of the low temperatures handling problems and the high fire and/or explosion hazard involved with use of $H_2$ or $CH_4$ as a fuel in an aircraft. Also, attempts have been made to produce fuels for high speed aircraft by making major changes in the physical composition of present day fuels, but such high speed fuels could not be used interchangably in lower speed aircraft.

In the past, there have been studies on the factors that affect the high temperature properties of hydrocarbon fuels. For example, an article coauthored by Thomas J. Wallace and myself, entitled "Kinetics of Deposit Formation from Hydrocarbon Fuels at High Temperatures", and appearing at pages 258 to 262 in Vol. 6, December, 1967, of I & EC Product Research and Development, discloses that molecular oxygen adversely affects fuel stability. The article also discloses that trace levels of sulfur compounds influence the deposit formation process, that olefins may adversely affect stability and that high temperature deposits contain higher sulfur and oxygen contents than the base fuel while low temperature deposits contain higher sulfur, oxygen and nitrogen contents. The article, however, is primarily concerned with aircraft fuels for a Mach 2.7 aircraft and temperatures on the order of about 500° F. and does not disclose how to produce a thermally stable fuel nor a fuel that can be used at higher temperatures nor the effects of trace compounds on deoxygenated fuels. Similarly, an article by A. C. Nixon and H. T. Henderson, entitled "Thermal Stability of Endothermic Heat-Sink Fuels", and appearing at pages 87 to 92 in Vol. 5, March, 1966 of I & EC Product Research and Development, discloses that deoxygenation will improve fuel stability. This article, however, is not concerned with the effects of trace impurity compounds such as sulfur and nitrogen compounds and primarily is concerned with pure hydrocarbon compounds. Previous work on deoxygenated jet fuels often produced erratic results in that thermal stability was improved in some cases but not in others and offered no clue as to why one fuel would improve in stability with deoxygenation and another would not. As a result, deoxygenation has not been generally accepted as a reliable method for improving jet fuel stability.

SUMMARY OF THE INVENTION

It has now been found that simply removing molecular oxygen does not guarantee an improvement in the thermal stability of liquid petroleum hydrocarbons. The present invention has found that liquid hydrocarbons blends having improved high temperature stability can be prepared by providing both a low dissolved molecular oxygen content in the hydrocarbon blend and a low content of certain trace impurities in the hydrocarbon blend including the sulfur content, organic oxygen content, and reactive olefin content of the hydrocarbons. Surprisingly, only certain classes of the trace compounds have been found to be deleterious and have to be controlled to a low level while other classes of these compounds have been found to be beneficial and can be added to the hydrocarbon blends to improve the thermal stability of the hydrocarbons. Also, some trace compounds that have previously been known to be beneficial in air saturated systems have been found to be deleterious in deoxygenated systems and vice versa.

Thus, in accordance with the present invention, the liquid hydrocarbon blends should contain less than 15 ppm by weight of dissolved molecular oxygen; less than 10 ppm by weight sulfur in the form of an organic sulfur compound classed as a thiol, sulfide, disulfide, or polysulfide; less than 10 ppm by weight oxygen in the form of an organic oxygen compound classed as a peroxide or hydroperoxide, and less than 0.20%, by volume, of reactive olefins.

Preferably, the liquid hydrocarbon blends contain less than 5 ppm by weight of dissolved molecular oxygen, and blends containing less than 2 ppm by weight of dissolved molecular oxygen are most preferred.

Preferably, the deoxygenated hydrocarbons contain less than 10 ppm oxygen in the form of an organic oxygen compound classed as a peroxide, hydroperoxide, paraffinic carboxylic acid, phenol, or amide. In air saturated hydrocarbons, alkyl phenols are widely used as additives to improve storage stability but surprisingly their presence is mildly deleterious in a deoxygenated hydrocarbon. It is also preferred that the deoxygenated hydrocarbons contain less than 5 ppm by weight nitrogen in the form of an organic nitrogen compound classed as an amide or an alkylpyridine.

The deoxygenated hydrocarbons preferably can contain dibenzothiophene or a substituted dibenzothiophene to improve thermal stability. Also, the deoxygenated hydrocarbon preferably can contain an organic nitrogen compound selected from the group consisting of the paraffinic amines, the carbazoles, and the piperidines to improve thermal stability. The improvement brought about by the use of carbazoles is particularly surprising because such compounds are highly deleterious in air-saturated hydrocarbons.

The hydrocarbon blends of the present invention can be prepared by either removing undesirable compounds from an existing hydrocarbon blend or by preparing a suitable hydrocarbon blend from components which do not contain any of the undesired compounds. Also, the additives that have been found to be beneficial can be provided in the blends by not removing them from blends which already contain them or by adding them to blends which do not contain them.

The hydrocarbon blends of the present invention when formulated for use as a turbine engine jet fuel in high speed aircraft possess a physical composition, that is, boiling point, density, flash point, viscosity, and the like, which is quite similar to present day liquid fuels and thus can be used interchangably in lower speed aircraft. The present invention can be used to formulate liquid hydrocarbon blends other than high speed jet fuel and having a $C_4$ to $C_{25}$ carbon number such as hydraulic fluids, lubricating oils, transformer oils, kerosene products, hydrocarbon rocket fuels, hydrocarbon based heat transfer fluids, diesel engine fuels, motor and aviation gasoline, and fuel and oils for ground based turbines. The thermal stability of the deoxygenated blends of the present invention are markedly improved in the temperature range of room temperature to about 1200° F. and are not affected by pressures up to 1000 psig such as would be present in a high speed aircraft fuel system.

DETAILED DESCRIPTION OF THE INVENTION

In accordance with the invention, a liquid hydrocarbon blend is provided which contains less than 15 ppm by weight of dissolved molecular oxygen. The liquid hydrocarbon blends that the present invention primarily is concerned with are jet fuel compositions. The present invention can be applied to all turbine engine liquid jet fuels as JP-4, JP-5, or Jet A fuel as well as any liquid hydrocarbon blend in the range of $C_4$ to $C_{25}$ carbon number. Jet fuel is a liquid blend containing various hydrocarbons generally including minor amounts of olefins and, generally, containing minor amounts of organic sulfur, nitrogen and oxygen compounds. The non-olefinic hydrocarbons present in jet fuel generally include normal and branched paraffins, monocycloparaffins such as cyclohexanes and cyclopentanes, dicycloparaffins such as decalin, tricycloparaffins, mononuclear aromatics such as alkyl benzenes, dinuclear aromatics such as naphthalenes, and other condensed ring compounds such as indanes, tetralines and acenaphthenes. The olefinic compounds found in jet fuel include mono-olefins, diolefins and triolefins. Organic sulfur compounds found in jet fuel include thiols (RSH where R is the hydrocarbon portion of the molecule), sulfides (R—S—R′), disulfides (R—S—S—R′), polysulfides ($R—S_x—R'$ where x ranges from 4 to 5), and thiophene compounds such as benzothiophenes and dibenzothiophenes. Organic nitrogen compounds found in jet fuels include pyrroles such as alkyl pyrroles, indoles and carbazoles, pyridines such as alkylpyridines and quinolines, amines ($RNH_2$, $R_2NH$ and $R_3N$ where R is an alkyl or aryl hydrocarbon group e.g. anilines), and amides $$(R—\overset{\overset{\displaystyle O}{\|}}{C}—NH_2).$$

Organic oxygen compounds found in jet fuel include peroxides (R—O—O—R′), hydroperoxides, (ROOH), carboxylic acids (RCOOH), phenols such as phenol and alkyl phenols, furans such as benzofuran and dibenzofuran, ketones $$(R—\overset{\overset{\displaystyle O}{\|}}{C}—R'),$$

alcohols (R—OH where R can be an alkyl or substituted alkyl group), and esters $$(R—\overset{\overset{\displaystyle O}{\|}}{C}—OR').$$

Normal handling of the fuel exposes it to the atmosphere and results in the presence of low levels of gases such as molecular oxygen ($O_2$) and molecular nitrogen ($N_2$). Jet fuels exposed to air generally contain 50 to 100 ppm by weight of molecular oxygen, depending on their detailed composition.

Various users of jet fuel have derived sets of specifications for their specific use which impose various restrictions on the composition of the fuels. For example, the specification for a military JP-4 fuel and military JP-5 fuel are given in the following Table 1.

TABLE 1

| | USAF MIL-T-5624H. Amend. 1 | | |
|---|---|---|---|
| | | JP-4 Wide-Cut | JP-5 High Flash Kerosene |
| COMPOSITION | | | |
| Acidity, Total (mg/KOH/g) | Max. | 0.015 | 0.015 |
| Aromatics (vol.%) | Max. | 25 | 25 |
| Olefins (vol.%) | Max. | 5 | 5 |
| Sulfur, Mercaptan (wt. %) | Max. | .001 | .001 |
| or Doctor Test N = Neg. | | N | N |
| Sulfur, Total (wt. %) | Max. | 0.4 | 0.4 |
| VOLATILITY | | | |
| Distillation Unit BP F | | Report | Report |
| Temp. 10% F | Max. | Report | 400 |
| 20% F | Max. | 290 | Report |
| 50% F | Max. | 370 | Report |
| 90% F | Max. | 470 | Report |
| 95% | | | |
| Final BP F | Max. | Report | 550 |
| Residue (%) | Max. | 1.5 | 1.5 |
| Loss (%) | Max. | 1.5 | 1.5 |
| Recovery at 400 F (%) | Max. | | |
| Explosiveness (vol. %) | Max. | | 50 |
| Flash Point (F) | Min. | | 140 |
| Gravity, API(60° F.) | | 45–57 | 36–48 |
| Gravity, Specific (60/60° F.) | | .802–.751 | .845–.788 |
| Vapor Pressure (1 lb Reid) | | 2–3 | |
| FLUIDITY | | | |
| Freezing Point (F) | Max. | −72 | −51 |
| Viscosity at −30° F. (est.) | Max. | | 16.5 |
| COMBUSTION | | | |
| Aniline-Gravity Product | Min. | 5250 | 4500 |
| or Net Heat of Comb. (Btu/lb) | Min. | 18400 | 18300 |
| Luminometer No. | Min. | 60 | 50 |
| or Smoke Point | Min. | | 19 |
| or Naphthalenes (Vol. %) | Max. | | |
| or Smoke-Volatility Index | Min. | 52 | |
| CORROSION | | | |

TABLE 1-continued

| | USAF MIL-T-5624H. Amend. 1 | | |
|---|---|---|---|
| | | JP-4 Wide-Cut | JP-5 High Flash Kerosene |
| Copper Strip (2 h at 212° F.) | Max. | 1 | 1 |
| Silver Strip | | | |
| STABILITY | | | |
| Coker JP (In. Hg.) | Max. | 3 | 3 |
| Coker Tuber Color Code | Max. | 3 | 3 |
| CONTAMINANTS | | | |
| Copper Content (mg/kg) | | | |
| Existent Gum (mg/100 ml) | Max. | 7 | 7 |
| Particulates (mg/liter) | Max. | 1.0 | 1.0 |
| Water Reaction Vol. Ch. (ml). | | | |
| Water Reaction Ratings | Max. | lb | |
| WSIM | Min. | 70 | 85 |
| ADDITIVES | | | |
| Anti-icing (vol. %) | | 0.10–0.15 | 0.10–0.15 |
| Antioxidant | | Option | Option |
| Corrosion Inhib. | | Required | Required |
| Metal Deactivator | | Option | Option |
| Antistatic | | | |
| OTHER | | | |
| Conductivity (CH) | | | |
| Filterability Time Min. | Max. | 15 | |
| Service | | All | Navy |
| Intended Use | | — | Aircraft Turbine Engines |

Generally the carbon numbers of jet fuel range from $C_5$ to $C_{16}$, aromatic content is held below 25 vol. %, olefin content is held below 5 vol. %, total sulfur content is held below 0.4 wt. % (4000 ppm S) and mercaptan or thiol sulfur content is held below 0.005 wt. % (50 ppm S).

A JP-5 jet fuel generally contains aromatic compounds such as benzenes, indanes, tetralins, and naphthalenes, cycloparaffins (naphthenes) including condensed and non-condensed cyclohexane and cyclopentane and small quantities of olefins including indene compounds. The boiling point and flash point requirements of JP-5 fuel generally restrict it to the $C_9$ to $C_{15}$ carbon range. Table 2 below gives a breakdown of a typical JP-5 jet fuel.

TABLE 2

GAS CHROMATOGRAPHIC ANALYSES OF JP-5 FUEL[1]

| Carbon Number | JP-5 |
|---|---|
| n-$C_9$ | 0.2 |
| $C_9$ | 0.6 |
| n-$C_{10}$ | 1.2 |
| $C_{10}$ | 1.7 |
| n-$C_{11}$ | 6.2 |
| $C_{11}$ | 8.6 |
| n-$C_{12}$ | 12.3 |
| $C_{12}$ | 24.3 |
| n-$C_{13}$ | 4.2 |
| $C_{13}$ | 28.3 |
| n-$C_{14}$ | 0.9 |
| $C_{14}$ | 9.2 |
| n-$C_{15}$ | 0.1 |
| $C_{15}$ | 2.1 |
| n-$C_{16}$ | |
| $C_{16}$ | 0.1 |

[1]GC Analysis via Perkin-Elmer 226; 300' Column, DC 550.
[2]Normal hydrocarbons as reported are a maximum value and may include other unresolvable compounds.

Jet fuel useful in the present invention desirably will have a boiling point range of 100° to 600° F., most usually 300° to 550° F., a specific gravity of 0.75 to 0.85, most usually 0.78 to 0.85, a minimum heat of combustion of 18,300 BTU/lb., a maximum freezing point of −50° F. and a flash point of at least 140° F.

THE EFFECT OF DEOXYGENATION

The effect of deoxygenation on the thermal stability of a variety of fuels at a temperature range of 300° to 1200° F. is demonstrated by the following test on six different hydrocarbon fuels, representing a broad spectrum of fuel stability levels, for the formation of carbonaceous deposits. The six fuels are first tested in the 300° to 600° F. range in their normal air-saturated condition having an oxygen content of between 57 to 75 ppm and then in a deoxygenated condition where the oxygen content has been reduced to less than 0.1 ppm to 1.4 ppm. Two of these fuels are then tested in the 700° F. to 1000° F. range, and one of these fuels was additionally tested at temperatures from 900° to 1200° F.

The tests are performed in an Advanced Fuel Unit designed to simulate the high pressures and temperatures that high speed aircraft would encounter. The Unit includes a ¼ inch outside diameter 304 stainless steel reactor tube having a 0.083 inch wall thickness and divided into four reaction zones. The low temperature range test uses reaction zones maintained at temperatures of 300°, 400°, 500°, and 600° F. and is run at 1000 psig for 4 hours. All tubes are cleaned on the inside prior to use in the run with a standard procedure comprising washing with acetone and chloroform and drying with nitrogen. Following the run, the reaction tube is removed, drained of fuel, evacuated and cut into four sections corresponding to the four temperature zones. The sections are then cut into four equal three inch lengths to determine how the deposit formation rate varies with position in each temperature zone. The individual sections are then analyzed for carbonaceous deposits. The local rate of deposit formation is then calculated for these three inch sections in terms of micrograms of carbonaceous deposits per centimeter squared of inner tube area per four hour reaction time.

The six fuels used in the test included (a) a fresh JP-5 fuel, (b) an aged JP-5 fuel (AFFB-9-67), (c) a highly refined JP-7 fuel (AFFB-11-68), (d) a highly refined P & W 523 fuel, (e) an intermediate quality fuel AFFB-8-67 containing a mixture of 30% JP-5 fuel and 70% thermally stable kerosene, and (f) fuel FA-S-1 (AFFB-4-64), a poor quality fuel. The specifications for each fuel are given below in Tables 3A–3F as well as a composition analysis of the fresh JP-5 fuel.

TABLE 3A

| Inspections on Fresh JP-5 Fuel | | |
|---|---|---|
| API Gravity 42.7 at | 60° F. | |
| ASTM Distillation, °F. | IBP | 336 |
| | 5% | 375 |
| | 10% | 386 |
| | 20 | 396 |
| | 30 | 404 |
| | 40 | 412 |
| | 50 | 418 |
| | 60 | 426 |
| | 70 | 434 |
| | 80 | 446 |
| | 90 | 460 |
| | 95 | 472 |
| | FBP | 490 |
| Recovery | 98.0 | |
| Batteries | 1.5 | |
| Loss | 0.5 | |
| Flash Point, °F. | | 140 |
| Total Sulfur | | 234 PPM |
| Mercaptan Sulfur | | <1 PPM |
| Existent Gum mg/100 ml | | 0.4 |

TABLE 3A-continued

| | |
|---|---|
| Potential Gum mg/100 ml | 0.9 |
| Peroxide Number, Milliequivalent of $O_2$ per liter | 1.0 |
| Trace Metals, Ash at 1000° F. | <.001%[a] |

[a]Insufficient ash for trace metals analysis by emission spectroscopy.

Composition of Fresh JP-5 Fuel by Mass Spectrographic Analysis

| | Composition, Wt. % |
|---|---|
| Paraffins | 43.2 |
| Naphthenes (Cycloparaffins) | |
| Monocycloparaffins | 25.3 |
| Dicycloparaffins | 8.5 |
| Tricycloparaffins | 3.3 |
| Total | 37.1 |
| Aromatics | |
| Alkylbenzenes | 12.5 |
| Indans + Tetralins | 3.8 |
| Indenes | 0.3 |
| Naphthalenes | 3.1 |
| Total | 19.7 |
| Grand Total | 100.0 |

TABLE 3B

AGED JP-5 FUEL ANALYSIS

| | Manufacturers Tests | Specification |
|---|---|---|
| API Gravity | 43.0 | 39 to 51* |
| Distillation, °F. - IBP | 356 | — |
| 10% | 378 | — |
| 20% | 390 | — |
| 50% | 414 | — |
| 90% | 458 | — |
| FBP | 494 | 550 max |
| Recovery, % | 97 | — |
| Residue, % | 1.5 | 1.5 max |
| Loss, % | 1.5 | 1.5 max |
| Existent gum, mg/100 ml | 0.6 | 7 max |
| Total potential gum, mg/100 ml | 5.2 | 14 max |
| Sulfur, weight % | 0.066 | 0.3 max* |
| RSH, % | 0.0006 | 0.001 max |
| Freeze point, °F. | −52.6 | −51 max |
| Aniline point, °F. | 145 | — |
| Aniline-gravity constant | 6235 | 4,600 min |
| Heat of combustion BTU/lb | 18,595 | 18,300 min |
| Viscosity at −30° F., cs | 9.8 | 15 max* |
| Aromatics, volume % | 13.7 | 20 max* |
| Olefins, volume % | 2.0 | 5 max |
| Saturates, volume % | 84.3 | — |
| Smoke point, mm | 20 | 19 min |
| Flash, °F. PM | 142 | 110 to 150* |
| Corrosion, ASTM D-130 | 1b | 1 max |
| WSIM | 99 | 85 min |
| Evaporation at 400° F. | 33.5 | 10 min |
| Doctor Test | Sweet | — |

| Thermal Stability (Std. Coker) | 300/400/6 | 375/475/6 | 375/473/6 |
|---|---|---|---|
| P, In. Hg. at 300 min | 0.0 | 0.1 | 1.1 |
| Preheater Code | 1 (Pass) | 3 (Fail) | 4 (Fail) |

*Exceptions to MIL-T-5624G

TABLE 3C

INSPECTIONS ON FUEL P&W 523

| | |
|---|---|
| Distillation, ASTM, F | |
| IBP | 403 |
| 10% | 414 |
| 30% | 419 |
| 50% | 426 |
| 70% | 434 |
| 90% | 449 |
| F.B.P. | 463 |
| Recovery % | 98.0 |
| Loss % | — |
| Residual % | 2.0 |
| Total Sulfur, ppm wt. | <0.2 |

TABLE 3C-continued

INSPECTIONS ON FUEL P&W 523

| | |
|---|---|
| Mercaptan Sulfur, ppm wt. | <0.2 |
| Total nitrogen, ppm | <1.0 |
| Basic Nitrogen, ppm | <1 |
| Peroxide No. millequiv. of $O_2$ per liter | Nil |
| Additives added to the fuel | Yes |
| Paraffin, Naphthene, Aromatic Distribution, Wt. %* | |
| Paraffins | 87.7 |
| Naphthenes (cycloparaffins) | |
| Noncondensed | 6.9 |
| 2-Ring Condensed | 0.8 |
| 3-Ring Condensed | 2.8 |
| Total | 10.5 |
| Aromatics: | |
| Alkyl Benzenes | 0.9 |
| Indans | 0.9 |
| Naphthalenes | 0.0 |
| Total | 1.8 |
| Grand Total | 100.0 |
| Olefin, Nonolefin Distribution, Vol. %** | |
| Olefins (nonaromatic) | 0.7 |
| Other | 99.3 |
| Total | 100.0 |

*Analysis by mass spectrometer.
**Analysis by FIA.

TABLE 3D

Inspections on Fuel JP-7

| General Physical and Chemical Tests | |
|---|---|
| Gravity, °API | 45.8 |
| Distillation, °F. | |
| IBP | 392 |
| 10% | 406 |
| 20% | 410 |
| 50% | 428 |
| 90% | 462 |
| EP | 494 |
| Res % | 1 |
| Color, saybolt | +30 |
| Flash pt, PM °F. | 172 |
| Freezing pt, D1477, °F. | −69 |
| Viscosity at −30° F. | 13.6 |
| Water tolerance | 1 |
| Sulfur, D1266, % wt. | 0.0003 |
| Mercaptan sulfur, % wt. | 1 |
| Corrosion, cu 2 hr 212° F. | 2.5 |
| Aromatic, % Vol. | |
| Olefins, % Vol. | |
| Smoke point | |
| Luminometer No. | 80.2 |
| Existent gum | 0.4 |
| Potential gum | |
| Net heating, But/lb | 18752 |
| Water separometer index | |
| Vapor pressure | |
| at 300° F. | 2.65 |
| at 500° F. | 44.0 |

TABLE 3E

Inspections on Intermediate Quality Fuel AFFB-8-67

| General Physical and Chemical Tests | |
|---|---|
| Gravity, °API | 47.0 |
| Distillation, °F. | |
| IBP | 334 |
| 10% | 350 |
| 20% | 357 |
| 50% | 370 |
| 90% | 434 |
| EP | 458 |
| Res % | 1 |

TABLE 3E-continued

| Inspections on Intermediate Quality Fuel AFFB-8-67 | |
|---|---|
| General Physical and Chemical Tests | |
| Color, saybolt | |
| Flash pt, PM °F. | 128 |
| Freezing pt, D1477 °F. | −76 |
| Viscosity at −30° F. | 5.65 |
| Water tolerance | 1 |
| Sulfur, D1266, % wt. | 0.019 |
| Mercaptan sulfur, % wt. | 0.001 |
| Corrosion, cu 2 hr 212° F. | 1-b |
| Aromatic, % Vol. | 8.9 |
| Olefins, % Vol. | 1.5 |
| Smoke point | 29 |
| Luminometer No. | |
| Existent gum | 0.2 |
| Potential gum | 1.5 |
| Net heating, Btu/lb | 18655 |
| Water separometer index | 74 |
| Vapor pressure | |
| at 300° F. | |
| at 500° F. | |
| Special Tests | |
| Peroxide No., ppm | 11.0 |
| Copper, ppb | 43.8 |
| Iron, ppb | 7.8 |
| Lead, ppb | 93.7 |

TABLE 3F

| FA-S-1 INSPECTION PROPERTIES | |
|---|---|
| Gravity, °API (ASTM D 287) | 43.8 |
| Distillation, °F. (ASTM D 86) | |
| Initial Boiling Point | 346 |
| 5% | — |
| 10% | 370 |
| 20% | 390 |
| 30% | — |
| 40% | — |
| 50% | 419 |
| 60% | — |
| 70% | — |
| 80% | — |
| 90% | 461 |
| 95% | — |
| End Point | 500 |
| Residue, vol. % | — |
| Loss, vol. % | — |
| Flash Point, °F. (ASTM D 56) | 129 |
| Freezing Point, °F. (ASTM D 1477) | −44 |
| Viscosity, Cs (ASTM D 445) | |
| at 100° F. | — |
| 60° F. | — |
| 0° F. | — |
| −30° F. | 9.39 |
| Water tolerance, vol. chg | — |
| Sulfur, wt. % | 0.16 |
| Mercaptan Sulfur, wt. % | 0.0001 |
| Corrosion, Cu Strip (ASTM D 130) | 1 |
| Aromatic Content, vol. %, (ASTM D 1319) | 16.7 |
| Smoke Point, mm | — |
| Luminometer No. (ASTM D 1740) | 50.9 |
| Existent Gum, mg/dl, (ASTM D 381) | 1.6 |
| Gum Potential, 16 hr, mg/dl (ASTM D 873) | 2.2 |
| Net Heat of Combustion, Btu/lb | 18,710 |
| Copper, mg/liter | 0.006 |
| Water Separometer Index (FTM 3256) | 18 |
| Total Acidity, mg KOH/g | 0.11 |

All of the fuels are deoxygenated by sparging with oxygen free helium with the exception of fuel FA-S-1 which is sparged with oxygen-free argon. The total deposit formed in each of the fuels tested in the low temperature range of 300° F. to 600° F. is reported in Table 4 below:

TABLE 4

The Effect of Deoxygenation on Total Deposits With a Spectrum of Fuel Types

| Fuel | $O_2$ Content PPM | Total Carbonaceous Deposits[a] Micrograms of Carbon | As PPM Based on Total Fuel |
|---|---|---|---|
| Fresh | 64 | 2,404 | 1.24 |
| JP-5 | 0.1 | 315 | 0.16 |
| Aged JP-5 | 58 | 3,992 | 2.05 |
| (AFFB-9-67) | <0.1 | 655 | 0.34 |
| JP-7 | 75 | 373 | 0.20 |
| (AFFB-11-68) | 0.7 | 257 | 0.13 |
| P&W 523 | 74 | 4,613 | 2.43 |
| | <0.1 | 882 | 0.46 |
| 30% JP-5, 70% thermally stable | 69 | 2,872 | 1.51 |
| (AFFB-8-67) | 0.3 | 589 | 0.31 |
| FA-S-1 | 57 | 8,157 | 4.21 |
| (AFFB-4-64) | 1.4 | 37,265 | 19.2 |

[a]Cumulative carbonaceous deposits produced in 4 hours in the Advanced Fuel Unit. Conditions: 1000 psig. S.S. 304 tube, Zone 1-300° F., Zone 2-400° F., Zone 3-500° F., Zone 4-600° F.

As can be seen from Table 4, a major reduction in the rate of deposit formation is obtained with both the fresh and aged JP-5 fuels. The total deposits formed with the deoxygenated JP-5 fuels are only approximately 15% of that experienced with the air-saturated JP-5 fuels. Also, local deposit formation rates at 600° F. are from 10 to 50 times lower with the deoxygenated JP-5 fuels than with the air-saturated JP-5 fuels.

The two highly refined fuels, JP-7 and P & W 523 fuel also show reductions in the rate of deposit formation at higher temperatures with deoxygenation. The intermediate quality fuel AFFB-8-67 also exhibits a significant reduction in deposit formation with deoxygenation. The FA-S-1 poor quality fuel, however fails to show a reduction in deposit formation with deoxygenation. The above results indicate that although deoxygenation can markedly improve fuel stability, it is not the sole answer for the fuel stability problem of any fuel, regardless of its nature. Thus, even in fuels where deoxygenation produces good results, the maximum potential of deoxygenation for improved stability can be realized only if additional specifications for the fuel are set.

The beneficial effect of rigorous deoxygenation on the thermal stability of the fresh and aged JP-5 fuels is also demonstrated by a test at a high temperature range of 700° F. to 1000° F. In this test, both of the fuels are rigorously deoxygenated by sparging with oxygen free helium. The fuels are tested in the advanced Fuel Unit using the same conditions and procedures described above except that the temperatures of the four zones are 700°, 800°, 900° and 1000° F. The effect of deoxygenation on the total deposits formed in the 700° to 1000° F. ranges is shown in Table 5 below.

TABLE 5

Effect of Deoxygenation on Total Deposits with a Fresh and Aged JP-5 Fuel in the 700 to 1000° F. Range

| Fuel | Oxygen Content PPM $O_2$ | Total Carbonaceous Deposits[a] Micrograms of Carbon | As PPM Based on Total Fuel |
|---|---|---|---|
| Fresh | 64 | 11,085 | 5.71 |
| JP-5 | 0.4 | 1,485[b] | 0.77 |
| Aged JP-5 | 58 | 9.105 | 4.68 |

TABLE 5-continued

Effect of Deoxygenation on Total Deposits with a Fresh and Aged JP-5 Fuel in the 700 to 1000° F. Range

| Fuel | Oxygen Content PPM $O_2$ | Total Carbonaceous Deposits[a] Micrograms of Carbon | As PPM Based on Total Fuel |
|---|---|---|---|
| AFFB-9-67 | 0.3 | 4,739 | 2.43 |

[a]Cumulative carbonaceous deposits produced in 4 hours in the Advanced Fuel Unit. Conditions: 1,000 psig; S.S. 304 tube; Zone 1-700° F., Zone 2-800° F.; Zone 3-900° F., Zone 4-1,000° F.
[b]Adjusted linearly to account for missing local deposit formation rate value.

As can be seen from Table 5, the total deposits formed with the deoxygenated fresh JP-5 fuel are 13% of the deposits formed with the air-saturated fuel. The total deposits formed with the deoxygenated aged JP-5 fuel, however, were reduced only to 52% of that obtained with the air-saturated fuel in the 700° to 1000° F. The stability of the fuels is also determined from a graph of their deposit formation rates in terms of breakpoint temperature, that is, the minimum temperature at which the deposit formation rate reaches 100 mg/cm$^2$/4 hours. The fresh rigorously deoxygenated JP-5 fuel did not reach its breakpoint temperature at 1000° F. so in order to determine its breakpoint temperature an additional run was made with it in the Advanced Fuel Unit having temperature zones at 900°, 1000°, 1100° and 1200° F. The results of the breakpoint temperature determinations are given in Table 6 below:

TABLE 6

| | Breakpoint Temperature °F. Air Saturated (58–64 PPM $O_2$) | Deoxygenated (less than 1 PPM $O_2$) | Change |
|---|---|---|---|
| Fresh JP-5 | 550 | 1100 | −550 |
| Aged JP-5 (AFFB-9-67) | 570 | 800 | +230 |

By comparison with the air-saturated run results, it can be seen from Table 6 that rigorous deoxygenation increases the fuel stability "breakpoint" temperature of the fresh JP-5 fuel by 550° F. and of the aged JP-5 fuel by 230° F. Results in the high temperature regime thus demonstrate that deoxygenation can bring about a major improvement in the stability of JP-5 fuel. Deoxygenation produced a much greater improvement in stability with the fresh JP-5 fuel than with the aged JP-5 fuel. These results show that other fuel specifications are needed to realize the maximum potential of deoxygenation to improve fuel stability.

The effect of oxygen concentration on the stability of the fuel is a function of the fuel composition, and in general lower oxygen concentrations in the fuel result in lower levels of deposit formation. The beneficial results of the present invention are obtained when the fuel has an oxygen content of less than 15 ppm by weight. Preferably, the molecular dissolved oxygen content of the fuels of the present invention is less than 5 ppm by weight and most preferably is less than 2 ppm by weight. The effect of oxygen concentration is demonstrated by tests run on the fresh JP-5 fuel and the aged JP-5 fuel. Each fuel is sparged at varying conditions to vary its molecular oxygen content. Runs in the Advanced Fuel Unit are made with the fresh JP-5 fuel at 1.6, 0.8 and 0.4 ppm $O_2$ concentration and with the aged JP-5 fuel at 14.6 and 0.3 ppm $O_2$ concentration. The Advanced Fuel Unit is operated at 1000 psig with a SS 304 tube and temperature zones at 700°, 800°, 900° and 1000° F. A comparison of total deposits formed at the varying oxygen content is shown in Table 7 below:

TABLE 7

The Effect of Oxygen Concentration on Total Deposit Formation With Fresh and Aged JP-5 Fuels

| Fuel | Oxygen Content PPM $O_2$ | Total Carbonaceous Deposits[a] Micrograms of Carbon | As PPM Based on Total Fuel |
|---|---|---|---|
| Fresh JP-5 | 0.4 | 1,485[b] | 0.77 |
| | 0.8 | 1,586 | 0.82 |
| | 1.6 | 3,843 | 1.98 |
| | 64 (air saturated) | 11,085 | 5.71 |
| Aged JP-5 (AFFB-9-67) | 0.3 | 4,739 | 2.43 |
| | 14.6 | 4,431 | 2.28 |
| | 58 (air saturated) | 9,105 | 4.68 |

[a]Cumulative deposits formed in a 4 hour run in the Advanced Fuel Unit. Other conditions: 1,000 psig; S.S. 304 tube; Zone 1-700° F.; Zone 2-800° F.; Zone 3-900° F.; Zone 4-1,000° F.
[b]Adjusted linearly to account for missing local deposit formation rate value.

As can be seen from Table 7, the response of the two fuels to the level of deoxygenation is different. Thus, the fresh JP-5 fuel shows essentially equivalent levels below 0.8 ppm $O_2$, but substantially higher levels at 1.6 ppm. In contrast, the level of deposit formation found with the aged JP-5 at 14.6 ppm $O_2$ is only twice as great as that found below 1 ppm. Thus, different fuels exhibit different effects of intermediate oxygen levels on deposit formation.

THE EFFECT OF TRACE IMPURITY SULFUR COMPOUND

In accordance with the invention, a low sulfur content of less than 10 ppm is provided in the fuel in the form of an organic sulfur compound classed as a thiol, sulfide, disulfide, or polysulfide because these compounds have been found to be deleterious to the thermal stability of a deoxygenated fuel.

Sulfur compounds are one of the major classes of trace impurity compounds present in jet fuel. Previous studies have shown that certain sulfur compounds increase the rate of deposit formation in molecular oxygen saturated fuels but the effect of sulfur compounds on the rate of deposit formation in a rigorously deoxygenated fuel had never been investigated. Sulfur compounds that are commonly found in fuels include thiols, sulfides, condensed thiophene compound, disulfides and polysulfides.

Present fuel specifications for a JP-5 fuel limit the presence of thiols (mercaptans) to a maximum of 10 ppm S (sulfur) because they produce undesirable odor and/or corrosion. Thiols thus are, in effect, barred from the fuel by existing specifications. Thiols are usually present in fuel because they are found in the parent crude from which the fuel is formed. Any excess thiol over 10 ppm thus must be removed from a JP-5 jet fuel to meet its specifications. Generally, excess thiols are removed by any one of a number of different sweetening processes well known in the art. Sulfur compounds other than thiols are not limited in a JP-5 jet fuel by any direct specification other than the fact that the fuel is limited to a maximum total sulfur content of 4000 ppm S.

The present invention has determined the effect of various sulfur compounds on the thermal stability of a deoxygenated jet fuel by adding different sulfur compounds to an actual JP-5 fuel and then testing the fuels in the Advanced Fuel Unit in accordance with the general procedures previously described for operating this Unit. Thus, total deposits and deposit formation rates which resulted from the presence of the added compound were determined and compared to the fuel without the added sulfur compounds. The deoxygenated fresh JP-5 fuel described above which demonstrated high stability when deoxygenated was used as the base fuel in this determination. Analysis of the fuel showed that it contained 234 ppm S and the various pure sulfur compounds were added to it so that the total added sulfur was 3000 ppm S. Thus, the total fuel sulfur level was within the present day JP-5 sulfur specification. The Advanced Fuel Unit was operated for four hours at 1000 psig with a 304 SS tube temperature zones at 700°, 800°, 900° and 1000° F. The results of these determinations are reported and discussed hereafter for the sulfur compounds classed as disulfides, polysulfides, sulfides, thiols and condensed thiophene compounds.

In accordance with the present invention, disulfides and polysulfides are kept to a minimum in the fuel because they have been found to be deleterious to the thermal stability of the fuel. Disulfides and polysulfides generally are not found in a JP-5 jet fuel as it is taken as a cut from a distillation column. The absence of these compounds in a distillation cut is believed due to their usual absence in the crude or the fact that the distillation step itself could destroy any JP-5 range disulfides and polysulfides.

Although disulfides and polysulfides initially are generally not present in a JP-5 fuel, they may be introduced into the fuel as a result of various sweetening operations performed thereon for the purpose of removing excess thiol from the fuel. In this regard, it should be noted that most sweetening processes, as the name implies, are carried out for odor control. These processes can be broadly classified into two groups, one that extracts the thiols and a second that converts the foul smelling thiols to less odorous disulfide compounds. Doctor sweetening is the oldest of commercially employed sweetening processes and operates by converting the thiols to disulfides by the use of elemental sulfur. Doctor sweetening, however, not only converts the thiols to disulfides but also may result in the formation of polysulfides. It and other sweetening processes using elemental sulfur are the only sweetening processes which introduce polysulfides into the fuel. Another sweetening process known as Inhibitor Sweetening oxidizes thiols to disulfides and at the same time increases the peroxide (hydroperoxide) content of the fuel. Still other sweetening processes in which thiols are oxidized to disulfides include the Hypochlorite Process, the Copper Chloride Process and Mercapfining. Thus, in practicing the present invention, these and other sweetening processes which operate by converting thiols to disulfides, and in the case of Doctor sweetening to polysulfides, preferably are avoided during the manufacture of the fuel because of the deleterious effect of these compounds on thermal stability. Instead, those processes which extract thiols preferably are used in the manufacture of the fuel. Typically, these processes use solvents such as sulfuric acid, caustic and sulfur dioxide to extract thiols. Solid absorbents have also been used to extract thiols and can be used in practicing the present invention.

The deleterious effect of disulfides and polysulfides on deposit formation in a deoxygenated fuel is shown by tests in the Advanced Fuel Unit in accordance with the general procedures outlined above for sulfur compounds. Compounds representative of those which would be produced by sweetening a jet fuel are added to a deoxygenated fresh JP-5 fuel. Ditertiary nonyl polysulfide is added to a JP-5 fuel as representative of a typical polysulfide and disulfides including ditertiary dodecyl disulfide, dibenzyl disulfide, and ditertiary butyl disulfide are also added to different JP-5 fuel samples. The ditertiary butyl disulfide is included in the test to determine if there is any effect of the molecular weight of the alkyl group in the disulfide. Although the disulfides and polysulfide compounds are added to produce the same total added ppm S (3000 ppm) the molar concentration of the polysulfide is lower than that of the disulfide because of the higher sulfur content in the polysulfide. After addition of the sulfur compounds, the fuels are rigorously deoxygenated by sparging with helium. Deposit formation rates are calculated and total deposits formed are shown in Table 8 below:

TABLE 8

The Effect of Added Polysulfide and Disulfides on Deposit Formation in a Deoxygenated Fresh JP-5 Fuel

| Sulfur Compound Added | Oxygen Content of Fuel, PPM | Total Carbonaceous Deposits: Micrograms of Carbon | Total Carbonaceous Deposits: As PPM Based on Total Fuel |
|---|---|---|---|
| Ditertiary nonyl polysulfide ($C_9H_{19}—S_5C_9H_{19}$) | 0.4 | 7,450 | 3.85 |
| Ditertiary dodecyl disulfide ($C_{12}H_{25}—S—S—C_{12}H_{25}$) | 0.9 | 7,295 | 3.76 |
| Dibenzyl disulfide 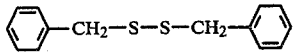 | 0.2 | 6,691 | 3.45 |
| Ditertiary butyl disulfide ($C_4H_9—S—S—C_4H_9$) | 0.2 | 10,659 | 5.51 |
| none | 0.4 | 1,485[a] | 0.77 |

[a]Adjusted linearly to account for missing local deposit formation rate value.

The deposit formation rates with the fuels containing the added disulfides and polysulfide compounds are markedly higher, in general, even though the fuel was rigorously deoxygenated.

As can be seen from Table 8, the total deposits formed as a result of the addition of the polysulfide are approximately equal to those formed when the dibenzyl disulfide and dodecyl sulfide are added to the fuel, in spite of the fact that the molar concentration of the polysulfides is less than half that of the disulfide. Thus, on a per molecule bases the polysulfide compound is more deleterious than a similar disulfide. Also, the use of butyl disulfide results in a higher total deposits than experienced by the use of dodecyl disulfide indicating that there is an effect of the size of the alkyl group in dialkyl disulfides.

The disulfide compounds that are to be kept to a minimum in the fuels usually have the general formula R—S—S—R′ where R and R′ are either the same or a different alkyl, aryl or arylalkyl radical having from 1 to 22 carbon atoms, with the sum of the carbon atoms of the R and R′ radical being no greater than 23. The polysulfide compounds that are to be kept to a minimum in the fuels usually have the general formula R—Sx—R′ where x is 4 or 5 and R and R′ are, again, the same or a different alkyl, aryl or arylakyl radical having from 1 to 18 carbon atoms, with the sum of the carbon atoms of the R and R′ radicals being no greater than 20.

In accordance with the invention, sulfides are kept to a minimum in the fuel because they have been found to be deleterious to the thermal stability of the fuel. Sulfides are one of the major sulfur compound classes present in a JP-5 jet fuel as a result of their being present in the parent crude from which the fuel is produced. The deleterious effects of sulfides on deposit formation in a deoxygenation fuel is shown by tests in the Advanced Fuel Unit in accordance with the general procedures outlined above for sulfur compounds. As representative sulfide compounds, a dialkyl sulfide (di-n-hexyl sulfide), a diaryl sulfide (diphenyl sulfide), three alkyl aryl sulfides (phenyl-n-propyl sulfide, phenyl benzyl sulfide and methyl phenyl sulfide) and a cyclic sulfide (thiacyclohexane) are added to different fuel samples of fresh JP-5 fuel. Although all of the sulfide compounds are added to produce a total added ppm S of 3000, the molar concentration of the sulfide compounds is higher than the molar concentration used in the tests of the disulfide and polysulfide compounds previously described. The fuels are rigorously deoxygenated by sparging with helium. Deposit formation rates are calculated and total deposits formed are shown in Table 9 below.

TABLE 9

The Effect of Sulfide Compound Type on Deposit Formation in a Deoxygenated Fresh JP-5 Fuel

| Sulfide Compound Added | Oxygen Content PPM $O_2$ | Total Carbonaceous Deposits Micrograms of Carbon | Total Carbonaceous Deposits As PPM Based on Total Fuel |
|---|---|---|---|
| Di-n-hexyl sulfide $C_6H_{13}—S—C_6H_{13}$ | 0.3 | 5,739 | 2.96 |
| Methyl Phenyl Sulfide 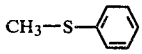 | 0.1 | 2,190 | 1.14 |
| Phenyl-n-propyl sulfide 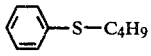 | 0.3 | 3,020 | 1.56 |
| Diphenyl sulfide 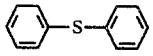 | 0.3 | 4,503 | 2.32 |
| Phenyl benzyl sulfide 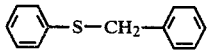 | 0.2 | 12,253 | 6.33 |
| Thiacyclohexane 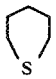 | 0.2 | 2,788 | 1.44 |
| none | 0.2 | 1,485[a] | 0.77 |

[a]Adjusted linearly to account for missing local deposit formation rate value.

As seen in Table 9, the presence of the sulfide compounds increase the total deposits, even though the fuel was rigorously deoxygenated. A comparison of deposit formation rates of the sulfides with those of the disulfides and polysulfides indicates that the polysulfides and disulfides are much more unstable than most of the sulfides.

The sulfide compounds that generally can be found in jet fuel and which are to be kept to a minimum in the fuels according to the present invention include those of the general formula R—S—R′ where R and R′ may be the same or a different alkyl, aryl, arylakyl, cycloalkyl or alkylcycloalkyl radical having 1 to 22 carbon atoms, with the sum of the carbon atoms of the R and R′ radicals being no greater than 24, and when the radical is a cycloalkyl or alkylcycloalkyl, it has from 5 to 10 carbon atoms in its ring portion. Typical of these sulfides are dialkyl sulfides of the general formula R—S—R′ where R and R′ are either the same or a different alkyl group (for example, di-n-hexyl sulfide); alkyl-aryl sulfides of the general formula R—S—Ar where R again is an alkyl group and Ar can be phenyl or a substituted phenyl (for example phenyl-n-propyl sulfide and phenyl-benzyl sulfide); di-aryl-sulfides of the general formula Ar—S—Ar′ where Ar and Ar′ can be either the same or a different phenyl or substituted phenyl (for example diphenyl sulfide); alkyl-cycloalkyl sulfides of the general formula R—S—R̂ where R again is an alkyl group and R̂ is a cycloalkyl or substituted cycloalkyl having from 5 to 10 carbon atoms in the ring portion thereof. Still other sulfides which are to be kept to a minimum are cyclic sulfides of the general formula

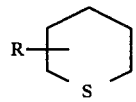

where R is hydrogen or an alkyl group having 1 to 8 carbon atoms (for example thiacyclohexane); and thianindans of the general formula

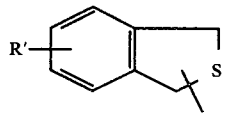

where R and R′ independently can be hydrogen or an alkyl group having from 1 to 14 carbon atoms, with the sum of the carbon atoms of the R and R′ groups being no greater than 16 (for example thianindan). These compounds can be kept to a minimum in the fuels by various controlled catalytic treatments described in greater detail below or by other techniques such as the use of selective absorbents.

In accordance with the invention, thiols are kept to a minimum in the fuel because they have been found to be deleterious to the thermal stability of the fuel. As previously indicated, thiols are currently limited to less than 10 ppm S in JP-5 fuel specification because of odor and/or corrosion. The deleterious effect of thiols on deposit formation in a deoxygenated fuel is shown by tests in the Advanced Fuel Unit in accordance with the general procedures outlined above for sulfur compounds. As representative of a typical alkyl thiol with a boiling point in the jet fuel range, 1-decanethiol is added to fresh JP-5 jet fuel. The fuel was rigorously deoxygenated by sparging with helium. Total deposits formed in the Advanced Fuel Unit during the run were 3909 micrograms of carbon (2.02 ppm based on total fuel) as compared to 1385 micrograms of carbon (0.77 ppm based on the total fuel) for a JP-5 fuel containing no added thiol. Thus, the addition of the thiol to the fuel increased total deposits in spite of the fact that the fuel was rigorously deoxygenated. The addition of the thiol, however, was not as deleterious as the polysulfide or disulfides tested above. The thiol compounds that generally can be found in jet fuel and which are to be kept to a minimum in the fuel in accordance with the present invention have the general formula R—S—H where R is an alkyl, aryl or arylalkyl radical having 1 to 24 carbon atoms. As previously discussed the thiols are preferably removed by extraction processes or any other process which does not produce disulfides and polysulfides which are left in the jet fuel product.

In accordance with a preferred embodiment of the invention, a dibenzothiophene is added to the fuel to improve its thermal stability. Thiophene compounds are, of course, one of the two major classes of sulfur compounds generally found in a JP-5 fuel as a result of their being present in the parent crude from which the fuel is produced. These sulfur compounds range from benzothiophene and alkyl benzothiophenes to dibenzothiophene and di(alkylbenzo)thiophenes and are mainly $C_9$ to $C_{24}$ carbon number benzothiophenes. In accordance with the present invention, it has been found that dibenzothiophenes improve the thermal stability of a JP-5 jet fuel and thus desirably are provided in such a fuel. The dibenzothiophene may be unsubstituted or substituted with one or more (e.g. 1 to 8) lower alkyl radicals having 1 to 4 carbon atoms, with the total number of carbon atoms in the entire compound being no greater than 22.

The improvement brought about by the use of a dibenzothiophene is demonstrated by tests in the Advanced Fuel Unit in accordance with the general procedures outlined above for sulfur compounds. In these tests, benzothiophene and dibenzothiophene are added to samples of fresh JP-5 jet fuel so that the total added sulfur level in the samples was 3000 ppm S. Although the thiophenes were present at the same ppm S level as the disulfides and polysulfide compounds tested above, their molar concentrations was twice that of the disulfide and five times that of the polysulfide because the thiophenes contain only a single sulfur atom. The fuels are rigorously deoxygenated after addition of the thiophenes. Total deposits formed are shown in Table 10 below.

TABLE 10

The Effect of Added Condensed Thiophene Sulfur Compounds on Deposit Formation in a Deoxygenated JP-5 Fuel

| Sulfur Compound Added | Oxygen Content PPM $O_2$ | Total Carbonaceous Deposits: Micrograms of Carbon | Total Carbonaceous Deposits: As PPM Based on Total Fuel |
|---|---|---|---|
| Benzo(b)thiophene 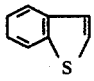 | 0.9 | 1,351 | 0.70 |
| Dibenzothiophene 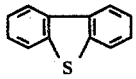 | 0.7 | 981 | 0.51 |
| none | 0.4 | 1,485[a] | 0.77 |

[a]Adjusted linearly to account for missing local deposit formation rate value.

As seen from Table 10, the total deposits formed are quite low and are essentially equal to or less than the deposits formed with a JP-5 fuel to which no thiophenes were added. The total deposits formed in the fuel where dibenzothiophene is added is substantially less than the base fuel. These results demonstrate that all sulfur compounds per se are not deleterious and that dibenzothiophene clearly functions as an inhibitor.

The improvement brought about by dibenzothiophene in fuels can be achieved by processing the fuel in such a manner to leave in the fuel the thiophenes ordinarily present in it. In general, sulfur removal from thiophene compounds is relatively difficult to effect, and in the use of such treating processes as hydrotreating processes to which the fuel is subjected thiophenes would be the last class of sulfur compounds to remain in the fuel. Dibenzothiophene can also be added directly to the fuel to bring about improvements in its thermal stability. Preferably, the dibenzothiophene is added in amounts of 0.1 to 1.0 wt. percent of the fuel and preferably 0.2 to 0.4 wt. percent.

THE EFFECT OF TRACE IMPURITY ORGANIC OXYGEN COMPOUNDS

In accordance with the invention, a low oxygen content of less than 10 ppm by weight is provided in the fuel in the form of an organic oxygen compound classed as a peroxide or hydroperoxide. A wide variety of oxygen compounds are potentially present in a jet fuel and it is generally assumed that more oxygen compounds are present in higher boiling fractions than in lower boiling fractions. A number of studies have shown that carboxylic acids and phenols are present in jet fuel range hydrocarbon fractions. A summary of the classes of oxygen compounds found in jet fuel range petroleum includes aliphatic carboxylic acids (fatty acids) of the formula $CH_3(CH_2)_nCOOH$ where n can vary between 3 and 12; cycloaliphatic carboxylic acids of the formula

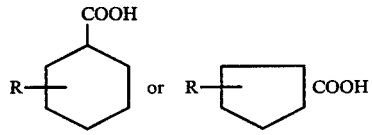

where R is hydrogen or an alkyl group having from 1 to 18 carbon atoms; phenols of the formula

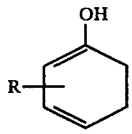

where R is hydrogen or an alkyl group having from 1 to 18 carbon atoms; furans of the formula

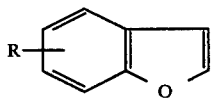

where R is hydrogen or an alkyl group having from 1 to 16 carbon atoms and of the formula

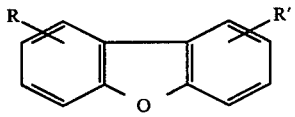

where R and R' independently are hydrogen or the same or a different alkyl group having from 1 to 10 carbon atoms, with the sum of the carbon atoms of the alkyl groups being no greater than 12; alcohols of the formula R—OH where R is an alkyl or cycloalkyl group having from 1 to 24 carbon atoms; esters of the formula

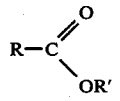

where R and R′ are either the same or a different alkyl, aryl or arylalkyl radical having from 1 to 18 carbon atoms, with the sum of the carbon atoms of the R and R′ radicals being no greater than 22; amides of the formula

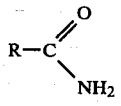

where R is an alkyl, aryl or arylalkyl radical having from 1 to 22 carbon atoms; hydroperoxides of the formula ROOH where R is an alkyl, aryl, and arylalkyl radical having from 1 to 22 carbon atoms; and peroxides of the formula R′OOR″ where R′ and R″ may be the same or a different alkyl, aryl or arylalkyl radical having from 1 to 22 carbon atoms, with the sum of the carbon atoms of the R′ and R″ radicals being no greater than 23.

Currently, there are no direct specifications limiting the amount of an oxygen containing compound in jet fuels except for specifications limiting the total acidity in accordance with a test comprising titration with KOH (ASTM D 974). This test, however, appears to limit only the carboxylic acid content present in the fuels. Hydroperoxides and peroxides are undoubtedly formed in jet fuel as a result of autoxidative reaction between the hydrocarbon components of the fuel and molecular oxygen. Currently, there is no direct specification limiting the peroxide content of a JP-5 fuel. Inspections on a number of fuels indicate peroxide numbers vary from nil to 2.2 milliequivalents of oxygen ($O_2$) per liter (in a JP-5 fuel this would be equivalent to approximately 90 ppm O). Molecular oxygen ($O_2$) is easily incorporated into hydrocarbon molecules via facile autoxidative reaction so that a wide spectrum and high level of oxygen types are potentially present in jet fuel from this source, in addition to those compounds present in the parent crude oil.

The present invention has determined the effect of various organic oxygen compounds on the thermal stability of a deoxygenated jet fuel by adding different organic oxygen compounds to an actual JP-5 fuel and then testing the fuels in the Advanced Fuel Unit in accordance with the general procedures previously described for operating this Unit. Thus, total deposits and deposit formation rates which resulted from the presence of the added compound were determined and compared to the deoxygenated fuel without the added organic oxygen compounds. The deoxygenated fresh JP-5 fuel described above which demonstrated high stability when deoxygenated was used as the base fuel in this determination. Analysis of the fuel showed that it had "trace" peroxide number readings, and the various pure compounds were added to it so that total added organic oxygen level was 100 ppm O. The Advanced Fuel Unit was operated for four hours at 1000 psig with a 304 SS tube and temperature zones at 700°, 800°, 900° and 1000° F. The results of these determinations are reported and discussed hereafter for the organic oxygen compounds classed as peroxides, hydroperoxides, carboxylic acids, and phenols.

In accordance with the invention, the peroxide and hydroperoxide content of the fuel is kept to a minimum because these compounds have been found to be deleterious to the thermal stability of the fuel. The deleterious effect of these compounds is demonstrated by tests in the Advanced Fuel Unit in accordance with the general procedures outlined above for organic oxygen compounds. As representative of typical jet fuel range peroxides and hydroperoxides, cumene hydroperoxide, t-butylhydroperoxide and di-t-butylperoxide were added to a fresh JP-5 fuel having a trace peroxide number reading in an amount such that the added organic oxygen level in the fuel is 100 ppm O. The fuel is then deoxygenated to remove molecular oxygen ($O_2$) by rigorously sparging the fuel with helium. Deposit formation rates for the deoxygenated fuel with and without added hydroperoxide were determined and are given in Table 11 below.

TABLE 11

The Effect of Added Peroxide or Hydroperoxides on Total Deposits in a Deoxygenated Fresh JP-5 Fuel

| Compound Added to the 100 PPM 0 Level | Molecular Oxygen Content PPM | Total Carbonaceous Deposits[a] Micrograms of Carbons | Total Carbonaceous Deposits[a] as PPM Based on Fuel |
|---|---|---|---|
| Di-t-Butylperoxide 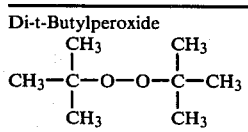 | 0.2 | 2,879 | 1.49 |
| Cumene Hydroperoxide 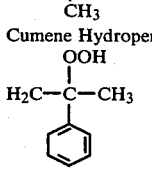 | 0.1 | 7,219 | 3.73 |
| t-butylhydroperoxide 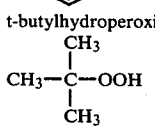 | 0.2 | 8,934 | 4.62 |
| None | 0.2 | 1,485[b] | 0.77 |

[a]Cumulative deposits formed in a four hour run in the Advanced Fuel Unit. Conditions: 1,000 psig, S.S. 304 tube, 10 cc/min flow rate, Zone 1 - 700° F., Zone 2 - 800° F., Zone 3 - 900° F., Zone 4 - 1,000° F.
[b]Adjusted for missing local deposit formation rate.

As can be seen from Table 11, a comparison of the total deposits show that the presence of the peroxide and hydroperoxides in the deoxygenated fuel resulted in markedly higher rates of deposit formation than that experienced with the "as is" deoxygenated fuel. In fact, very high deposit formation rates were experienced at relatively low temperatures in the deoxygenated fuel having added peroxide and hydroperoxide. The results from the test demonstrate that peroxides and hydroperoxides should be excluded from high stability JP-5 fuel. These hydroperoxides typically form during prolonged periods of transportation or storage before deoxygenation. Hydroperoxide and peroxide compounds can be eliminated from the fuel by subjecting the fuel to a controlled catalytic treatment with hydrogen as more fully described hereafter.

In a preferred embodiment of the invention, the paraffinic carboxylic acid content of the fuel is kept to a minimum because these compounds have been found to be deleterious to the thermal stability of the fuel. The deleterious effect of these compounds is demonstrated by tests in the Advanced Fuel Unit in accordance with the general procedures outlined above for organic oxygen compounds. In these tests, representative unsubstituted and alkyl substituted cycloaliphatic acids and an alkanoic acid are added to samples of a fresh JP-5 fuel in amounts such that the added organic oxygen level in the fuel is 100 ppm O. The unsubstituted and alkyl substituted cycloaliphatic acids used include cyclohexane carboxylic acid and a commercial mixture of naphthenic acids. The paraffinic acid used was decanoic acid which is representative of a paraffinic carboxylic acid potentially present in jet fuel. After addition of these acids, the fuel samples were rigorously deoxygenated by sparging with helium to reduce the oxygen content to less than 1 ppm. Total deposits formed with the naphthenic acids are shown in Table 12A below and with the paraffinic carboxylic acid in Table 12B below.

TABLE 12

The Effect of Naphthenic Carboxylic Acids on Deposit Formation in a Deoxygenated Fresh JP-5 Fuel

| Carboxylic Acid Added at the 100 PPM 0 Level | Molecular Oxygen Content PPM $O_2$ | Total Carbonaceous Deposits: Micrograms of Carbon | Total Carbonaceous Deposits: as PPM Based on Total Fuel |
|---|---|---|---|
| Cyclohexane Carboxylic 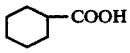 | 0.1 | 1,563 | 0.82 |
| Mixed naphthenic Acids | 0.1 | 1,254 | 0.65 |
| None | 0.4 | 1,485[a] | 0.77 |
| Decanoic Acid $CH_3—(CH_2)_8—COOH$ | 0.1 | 2,997 | 1.54 |
| None | 0.4 | 1,485[a] | 0.77 |

[a]Adjusted for missing local deposit formation rate value.

As seen from Table 12A, the cyclohexane carboxylic acid containing fuel and the fuel containing the commercial mixed naphthenic acids produced essentially the same total deposits as the fuel to which no carboxylic acid had been added. The presence of these acids thus are not deleterious toward deposit formation in the deoxygenated fuel. In contrast, as seen in Table 12B, the presence of decanoic acid in the deoxygenated fuel resulted in an approximate 100% increase in total deposits as compared to a fuel having no added decanoic acid. Carboxylic acids can be removed from fuel by caustic treating as described in greater detail hereafter. Other methods of removing carboxylic acids can be used including catalytic treatment with hydrogen.

In accordance with a preferred embodiment of the invention, the amount of phenolic compound in the fuel is kept to a minimum because they have been found to be deleterious to the thermal stability of the fuel. Phenolic compounds have been reported to be present in jet fuel range hydrocarbons, but no current specifications exist to control their level in jet fuel. Studies indicate that such compounds may be present in jet fuel in amounts ranging from about 325 to 500 ppm O. The deleterious effect of phenols on deposit formations in a deoxygenated fuel is shown by tests in the Advanced Fuel Unit in accordance with the general procedures outlined above for organic oxygen compounds. Three phenolic compounds typical of those reported in jet fuel range hydrocarbons are added to fresh JP-5 jet fuel. The phenolic compounds added were o-cresol, 2,6-dimethyl phenol and 2,4,6-trimethyl phenol. The molecular oxygen content ($O_2$) of the fuels containing the added phenols was reduced to less than 1 ppm by sparging with helium. Total deposits in the fuels are listed in Table 13 below.

TABLE 13

The Effect of Phenolic Compounds on Deposit Formations in a Deoxygenated Fresh JP-5 Fuel

| Phenolic Compound Added at the 100 PPM 0 Level | Molecular Oxygen Content PPM $O_2$ | Total Carbonaceous Deposits: Micrograms of Carbon | Total Carbonaceous Deposits: as PPM Based on Total Fuel |
|---|---|---|---|
| 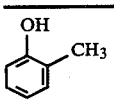 2,6-Dimethylphenol | 0.2 | 1,561 | 0.81 |
| 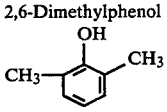 2,4,6-Trimethylphenol | 0.1 | 2,048 | 1.06 |
| 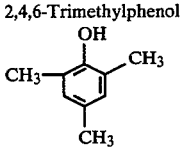 | 0.1 | 1,451 | 0.75 |
| None | 0.4 | 1,485[a] | 0.77 |

[a]Adjusted for missing local deposit formation rate value.

As can be seen from Table 13, the presence of the phenolic compounds has a mildly deleterious effect on the total deposit formed in the deoxygenated fuel. The fuels containing o-cresol and the 2,4,6-trimethylphenol produced essentially the same total deposits as did the base fuel with no added organic oxygen compound. The fuel containing the 2,6-dimethylphenol produced approximately 35% higher total deposits than did the base fuel. Deposit formation rates for the phenol containing fuels were determined and these rates exhibited a slight maxima at approximately 800° F. These rates appear to be generally higher than the rate obtained with the phenol-free based fuel. Thus, in this temperature regime, the presence of the phenols appears to be contributing to a slightly higher deposit formation rate. This overall mild deleterious effect of phenols is in contrast to the behavior of these compounds in air-saturated fuels at lower temperatures where alkylated phenols are employed as free radical scavengers to suppress the autoxidative chain reactions which result in sediment and deposit formation.

Phenols can be removed from fuel simultaneously with carboxylic acids by caustic treating as described hereafter. Other methods of removing phenols can be used such as catalytic treatment using hydrogen. The present invention has also discovered that amides are deleterious and should be kept to a minimum. Amides can be removed from fuel simultaneously with phenols and carboxylic acids by catalytic treatment with hydrogen.

Thus, in accordance with the present invention, peroxides, hydroperoxides, paraffinic carboxylic acids, amides and phenols are kept to a minimum in the fuel. The total combined amount of all of these compounds in the fuel should be maintained at less than 10 ppm O and preferably less than 5 ppm O.

THE EFFECT OF TRACE IMPURITY OLEFIN COMPOUNDS

In accordance with the invention, the fuel is provided with less than 0.20% by volume of reactive olefins. Reactive olefins usually present in jet fuel range hydrocarbons include: indenes; paraffinic olefins such as decene, and dodecene; cyclic olefins such as cyclohexene; and aromatic olefins such as styrene.

Present fuel specifications for JP-5 fuel (MIL-T-5624H) allow up to 5 vol. % olefins. A number of studies have shown that the presence of olefins is deleterious in air-saturated hydrocarbon systems. Similarly, studies have shown that olefins undergo rapid, free radical autoxidation. The present invention has found that these compounds are also deleterious in a deoxygenated fuel and thus should be kept to a minimum in the fuel.

To demonstrate the effect of these olefins in a deoxygenated hydrocarbon, the following test was carried out using a pure compound blend simulated jet fuel. Such a blend was chosen because it is known to be free of olefins and trace impurities such as sulfur, nitrogen and organic compounds. The four component pure hydrocarbon blend contained 25% normal paraffin (n-dodecane), 25% branched paraffin (2,2,5 trimethylhexane), 30% single ring naphthene (iso-propylcyclohexane) and 20% single ring aromatic (sec-butyl-benzene).

The effect of olefins in this blend was evaluated at the 2 wt. % level, which is well below current specifications for total olefin concentration in JP-5 fuel. This 2% level, although below the maximum specification value, is more representative of typical olefin levels in actual JP-5 fuels over the past decade. A paraffinic monoolefin (1-dodecene), a cyclic monoolefin (cyclohexene); and several aromatic monoolefins (including α-methylstyrene, alkylbenzene and indene) were chosen for this test.

The simulated fuels were tested in the Advanced Fuel Unit operating at 1,000 psig with a S.S. 304 tube and temperature zones at 800°, 900°, 1000° and 1100° F. with a feed rate of 2.5 cc/minute. The feed material was rigorously deoxygenated by sparging them with helium. The distribution of local deposit formation rates were determined and for comparison purposes rate data was obtained with the pure compound blend with added olefin. Total deposits formed are shown in Tables 14A and B.

TABLE 14A

THE EFFECT OF A PARAFFINIC AND A CYCLIC MONO-OLEFIN ON TOTAL DEPOSITS IN A DEOXYGENATED PURE HYDROCARBON COMPOUND BLEND

| Olefin Added at the 2 Wt. % Level | Oxygen Content of Blend PPM $O_2$ | Total Carbonaceous Deposits, Micrograms[a] |
|---|---|---|
| 1-dodecene $CH_3-(CH_2)_9-CH=CH_2$ | 0.1 | 7,002 |
| Cyclohexene 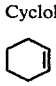 | 0.1 | 9,690 |
| None | 0.1 | 6,760 |

[a]Cumulative deposits in a four hour run in the Advanced Fuel Unit. Conditions: 1,000 psig, a S.S. 304 tube, Zone 1 - 800° F. Zone 2 - 900° F. Zone 3 - 1,000° F. Zone 4 - 1,100° F. Flow rate 2.5 cc/minute.

TABLE 14B

THE EFFECT OF AROMATIC OLEFINS ON TOTAL DEPOSITS IN A DEOXYGENATED PURE HYDROCARBON COMPOUND BLEND

| Olefin Added at the 2 Wt. % Level | Oxygen Content of Blend, PPM $O_2$ | Total Carbonaceous Deposits, Micrograms[b] |
|---|---|---|
| -methylstyrene $CH_3-CH=CH_2$ 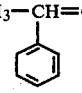 | 0.1 | 2,964 |
| allylbenzene $H_2C-CH=CH_2$ 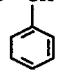 | 0.3 | 2,364[a] |
| indene 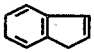 | 1 | 12,612[a] |
| None | 0.1 | 6,760 |

[a]Adjusted for missing local deposit formation value.
[b]Cumulative deposits in a 4 hour run in the Advanced Fuel Unit. Conditions: 1,000 psig, a S.S. 304 tube, Zone 1 - 800° F., Zone 2 - 900° F., Zone 3 - 1,000° F., Zone 4 - 1,100° F. Flow rate 2.5 cc/min.

As can be seen from Table 14A, the presence of 1-dodecene and cyclohexene in general has a mildly deleterious effect on the deposit formation process in the deoxygenated system. Both total deposits as shown in Table 14A and local deposit formation rates are quite similar. Deposit formation rates remain quite low until approximately 1000° F., at which point the deposit formation rate increases sharply with increasing temperature, presumably as a result of the increasing influence of pyrrolysis reactions in this temperature regime. In contrast, the presence of α-methylstyrene resulted in markedly higher deposit formation rates at temperatures below 700° F. At higher temperatures, however, the deposit formation rates were somewhat lower, which resulted in lower total deposits as shown in Table 14B. Nevertheless, the presence of α-methylstyrene in the deoxygenated system is clearly deleterious since it results in markedly higher deposit formation rates across the range of temperatures where a deoxygenated hydrocarbon fuel should be experiencing little, if any deposit formation. The presence of allylbenzene did not increase either deposit formation rates at low temperatures or total deposits. By contrast, indene increased both deposit formation rates at low temperatures and total deposits and was clearly highly deleterious. It can be seen that olefins as a class contain many deleterious compound types and should be kept to a minimum in the present invention. These olefins can be removed by a catalytic treatment, with hydrogen as described in greater detail below or by such methods as acid treatment followed by distillation.

THE EFFECT OF TRACE IMPURITY NITROGEN COMPOUNDS

In accordance with a preferred embodiment of the invention, the deoxygenated fuel is provided with less than 5 ppm by weight nitrogen in the form of an organic nitrogen compound classed as an amide or an alkylpyridine because these compounds have been found to be deleterious to thermal stability.

Nitrogen compounds are present as minor constituents in crude oil boiling in the jet fuel range and are carried over into petroleum fractions obtained from the crude. The nature and quantity of these compounds is a function of crude source and of the boiling range for a given crude. The nitrogen content of crude oil varies widely. Generally, the quantity of nitrogen compounds in a crude fraction increases with increasing boiling point of the crude fraction. Moreover, future sources of petroleum type liquids such as those derived from shale oil can be much higher in nitrogen content. Petroleum refining processes often change the level and type of nitrogen compounds in the petroleum fraction by either adding or subtracting nitrogen compounds from the jet boiling range and by changing the chemical composition of the nitrogen compounds. For example, processes such as mild catalytic hydrotreating or passing the fuel over an adsorption media such as clay will remove nitrogen and sulfur compounds. In contrast, cracking of higher molecular weight fractions to the jet fuel range can add more nitrogen to the fuel than would normally be present in a fuel prepared with straight run stocks. The refinery process can also alter the distribution of basic and non-basic nitrogen compounds present in the petroleum fraction. Generally, nitrogen compounds that can be found in jet fuel range petroleum cuts include pyrroles, indoles, carbazoles, pyridines, quinolines, tetrahydroquinolines, anilines and amides.

In a manner similar to that described above with respect to sulfur compounds, the effect of various nitrogen compounds on the thermal stability of the deoxygenated jet fuel was determined by adding different pure nitrogen compounds to an actual JP-5 fuel and then to measure any change in total deposits and deposit formation rates which results from the presence of the added compound. The fresh JP-5 fuel, which demonstrated high stability when deoxygenated, was chosen as the base fuel for this study. There is no current specification for nitrogen content of JP-5 jet fuel but analyses indicated the fuel contained less than 1 ppm N. The effect of nitrogen compound types was tested at the 100 ppm N level because this was felt to be representative of a probably maximum nitrogen content which could result from the use of high nitrogen containing stocks such as those obtained from California crudes.

In accordance with the invention, alkyl pyridines have been found to have a mildly deleterious effect on the thermal stability of the fuel. This deleterious effect is shown by the following test where three pyridine type nitrogen compounds, trimethylpyridine, quinoline (benzopyridine) and methylquinoline were added to JP-5 fuel samples so that the total added nitrogen level was 100 ppm N. The resulting nitrogen fuels were rigorously deoxygenated by sparging with helium and tested in the Advanced Fuel Unit operating at 1000 psig with a SS 304 tube and temperature zones at 700°, 800°, 900°, and 1000° F. The total deposits formed in this test are shown in Table 15.

TABLE 15

Effect of Pyridine Type Nitrogen Compounds on Deposit Formation in a Deoxygenated JP-5 Fuel

| Nitrogen Compound Added at the 100 ppm Level | Oxygen Content ppm $O_2$ | Total Carbonaceous Deposits[a] Micrograms of Carbon | as ppm Based on Total Fuel |
|---|---|---|---|
| 2,4,6-trimethyl-pyridine 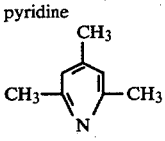 | 0.2 | 1,977 | 0.02 |

TABLE 15-continued

Effect of Pyridine Type Nitrogen Compounds on Deposit Formation in a Deoxygenated JP-5 Fuel

| Nitrogen Compound Added at the 100 ppm Level | Oxygen Content ppm $O_2$ | Total Carbonaceous Deposits[a] Micrograms of Carbon | as ppm Based on Total Fuel |
|---|---|---|---|
| Quinoline (benzo(b)pyridine) 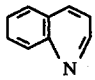 | 0.2 | 1,457 | 0.75 |
| 2-Methylquinoline 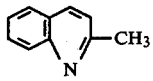 | 0.1 | 1,330 | 0.69 |
| None | 0.4 | 1,485[b] | 0.77 |

[a]Cummulative deposits formed in a 4 hour run in the Advanced Fuel Unit. Conditions: 1,000 psig, S.S. 304 tube, Zone 1-700° F., Zone 2-800° F., Zone 3-900° F., Zone 4-1000° F.
[b]Adjusted for missing local deposit formation rate value.

As seen in Table 15, the presence of trimethylpyridine resulted in slightly higher total deposits, reflecting slightly higher local deposit rates in the majority of the temperature zones employed. The total deposit obtained with the quinoline and methylquinoline containing fuels are essentially equal to that obtained with the fuel to which no nitrogen compound was added. Thus, in general pyridine type nitrogen compounds have little effect on deposit formation in a deoxygenated fuel, but alkyl pyridine compounds have a mildly deleterious effect, and desirably are removed from the fuel. The alkyl pyridines that should be removed usually are of the general formula

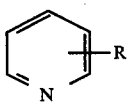

where R is 1 or more alkyl groups having 1 to 18 carbon atoms in each group, with the total number of carbon atoms in the compound being no greater than 24. These compounds can be removed by a controlled acid washing step followed by a water wash and redistillation of the product as described in greater detail hereafter. These compounds can also be removed by catalytic treatment with hydrogen.

In accordance with a preferred embodiment of the invention, a carbazole compound is added to the fuel because it has been found to have an inhibiting effect on deposit formation. Most pyrroles are non-basic nitrogen compounds and these compounds have generally been found to predominate among the nitrogen compounds found in kerosene range hydrocarbons. Pyrroles have been found to be very deleterious toward stability in air saturated systems both at fuel storage conditions and "empty" wing tank conditions. Surprisingly, the present invention has discovered that in deoxygenated systems, certain pyrroles reduce deposit formation. To demonstrate the effect of pyrroles, the compounds 2,5 dimethyl pyrrole, indole (benzopyrrole) and carbazole (dibenzopyrrole) were added to a JP-5 fuel as representative of alkyl pyrroles, indoles and carbazoles that are all potentially present in JP-5 range jet fuel. All of these nitrogen compounds were added at 100 ppm N level.

Conditions employed on the Advanced Fuel Unit were 1000 psig, a SS 304 tube and temperature zones at 700°, 800°, 900°, and 1000° F. The fuels were rigorously deoxygenated by sparging with helium. Total deposits formed in the Advanced Fuel Unit are shown in Table 16 for the fuels with and without added nitrogen.

TABLE 16

EFFECT OF PYRROLE TYPE NITROGEN COMPOUNDS ON DEPOSIT FORMATION IN A DEOXYGENATED JP-5 FUEL

| Nitrogen Compound Added at the 100 ppm N Level | Oxygen Content ppm $O_2$ | Total Carbonaceous Deposits[a] Micrograms of Carbon | Total Carbonaceous Deposits[a] as ppm Based on Total Fuel |
|---|---|---|---|
| 2,5 Dimethylpyrrole 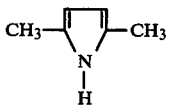 | 0.3 | 1,310[b] | 0.68 |
| INDOLE (Benzo(b)pyrrole) 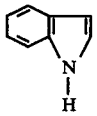 | 0.2 | 1,316 | 0.68 |
| CARBAZOLE (Dibenzopyrrole) 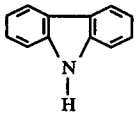 | 0.2 | 1,028 | 0.54 |
| none | 0.4 | 1,485[b] | 0.77 |

[a]Cumulative deposits formed in a 4 hour run in the Advanced Fuel Unit. Conditions: 1,000 psig, S.S. 304 Tube, Zone 1-700° F., Zone 2-800° F., Zone 3-900° F., Zone 4-1000° F.
[b]Adjusted for missing local deposit formation rate value.

As can be seen from Table 16, the dimethyl pyrrole, indole and carbazole containing fuels formed less total deposits than the fuel to which no nitrogen was added. The lowest deposit formation rates were obtained with the carbazole containing fuel, which exhibited essentially a zero apparent activation energy for the deposit formation process.

It can be seen that in terms of the total deposits formed, the pyrrole type nitrogen compounds tested are not deleterious in a deoxygenated fuel and in fact are beneficial. This effect of pyrrole type nitrogen compounds in deoxygenated fuel is in complete contrast to their highly deleterious nature previously observed in air-saturated systems. The pyrrole type compounds tested, particularly dibenzopyrrole (carbazole), inhibit the overall formation of deposits in the deoxygenated fuel.

Carbazole compounds which can be used to improve the thermal stability of the fuel include those of the general formula

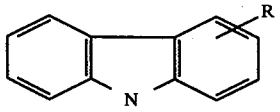

where R can be one or more hydrogen radicals or one or more alkyl groups having from 1 to 12 (preferably 1 to 3) carbon atoms in each group, with the total number of carbon atoms in the alkyl groups being no greater than 12. Carbazoles are often present in jet range fuel in an amount to bring about improved thermal stability. Various treatment steps that the fuel may be subjected to, such as acid washings, if not carefully controlled, can remove carbazoles and other pyrroles and thus it may be necessary to add additional carbazoles to the fuel when it is desired to obtain their thermal stability effect.

In addition to the beneficial effect obtained with pyrroles, paraffinic amines and piperidine compounds have also been found to reduce deposit formation. This improvement is demonstrated in the following test in the Advanced Fuel Unit where an aromatic amine (2,6-dimethylaniline), a paraffinic amine (hexylamine), a naphthenic amine (N-methylcyclohexyl amine) and a non-aromatic heterocyclic nitrogen compound (2-methylpiperidine) were added to a fresh JP-5 fuel. All of these nitrogen compounds were tested at the 100 ppm N level.

Conditions employed in the Advanced Fuel Unit were 1000 psig, a SS 304 tube and temperature zones at 700°, 800°, 900° and 1,000° F. The fuels were rigorously deoxygenated by sparging with helium. Total deposits formed in the Advanced Fuel Unit for the fuels with and without nitrogen additions are shown in Table 17.

TABLE 17

THE EFFECT OF NITROGEN COMPOUNDS OTHER THAN PYRROLES AND PYRIDINES ON DEPOSIT FORMATION IN A DEOXYGENATED JP-5 FUEL

| Nitrogen Compound Added at the 100 ppm N Level | Oxygen Content ppm $O_2$ | Total Carbonaceous Deposits[a] Micrograms of Carbon | Total Carbonaceous Deposits[a] as ppm Based on Total Fuel |
|---|---|---|---|
| 2,6 Dimethylaniline 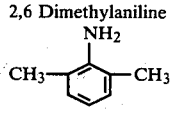 | 0.2 | 1,441[b] | 0.75 |
| Hexylamine $CH_3—(CH_2)_5—NH_2$ | 0.3 | 1,228[b] | 0.63 |
| N—Methylcyclohexyl amine 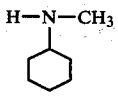 | 0.2 | 1,411 | 0.73 |
| 2-Methylpiperidine 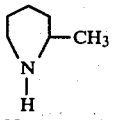 | 0.1 | 1,049 | 0.54 |
| None | 0.4 | 1,485[b] | 0.77 |

[a]Cumulative deposits formed in a 4 hour run in the Advanced Fuel Unit. Conditions: 1,000 psig, S.S. 304 tube, zone 1 - 700° F., zone 2 - 800° F., zone 3 - 900° F., zone 4 - 1,000° F.
[b]Adjusted for missing rate value.

As can be seen from Table 17, none of the amine compounds tested significantly altered the total deposits formed from the deoxygenated JP-5 fuel. The presence of the methylpiperidine and hexylamine, however, reduced the total deposits formed, indicating that these compounds have a mild inhibiting effect on the overall deposit formation process.

Paraffinic amines that can be added to the fuels to improve their thermal stability include primary amines of the general formula $RNH_2$ where R is an alkyl group having from 1 to 22 carbon atoms, preferably 5 to 15 carbon atoms. Piperidine compounds that can be added to the fuels to improve their thermal stability include those of the general formula

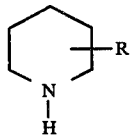

where R is one or more hydrogen radicals or one or more alkyl groups having 1 to 18 (preferably 1 to 6) carbon atoms in each group, with the total number of carbon atoms in the alkyl groups being no more than 18. Paraffinic amines and piperidines normally are present in jet range fuel and various treatment steps that the fuel may be subject to, such as acid washings, will remove these compounds from the fuel. Thus, paraffinic amines and piperidines are normally added to the fuel to obtain their improved thermal stability effect when it is desired. The nitrogen compounds which improve the thermal stability of a fuel can be added to the fuel in a concentration between 10 to 1000 ppm N and preferably 50 to 200 ppm N. This nitrogen content can be provided by a single nitrogen improving additive or a combination of two or more of these additives. The nitrogen improving additives are preferably added following the final treating step by use of petroleum derived, coal tar derived, or synthesized compounds.

PREPARATION OF THERMALLY STABLE HYDROCARBON BLENDS

The present invention has determined that various trace compounds which increase deposit formation should be eliminated from hydrocarbon fuel blends while others which decrease such deposits desirably should be added. To achieve the addition and deletion of the trace compounds, a variety of petroleum processing schemes can be used to prepare the product. Indeed, the product may be a blend of materials prepared in different manners. However, because of the strong effect on stability of low levels of deleterious compounds all blending stocks used to prepare the final product must be prepared carefully. It is also important to avoid the use of processes which are useful for one purpose but which will also introduce deleterious compounds into the product. For example, as previously discussed, certain sweetening processes remove deleterious mercaptans from liquid petroleum fractions by converting these mercaptans to disulfides which are predominately left in the hydrocarbon product. Sweetening processes which employ elemental sulfur such as Doctor Sweetening, can also produce polysulfides which also are predominately left in the hydrocarbon product. Thus, Sweetening processes which leave deleterious disulfides or polysulfides in the product should not be employed to remove mercaptans.

One processing scheme to prepare the product is as follows:

A 350°/540° F. cut is made from crude oil in an atmospheric pipe still or distillation column. Distillation is a process which separates the various compounds present in a given crude oil or petroleum fraction by their boiling point. Generally, no chemical change takes place during the distillation. Even for this relatively simple physical separation process, considerable variation exists in the type and design of equipment. Jet fuel fractions are normally prepared on an atmospheric pipe still (a distillation column operated slightly above atmospheric pressure). Generally, the overhead distillate is a naphtha cut (up to about 400° F. final boiling point), with the first sidestream product being a kerosene jet fuel cut. Although the pipe still is designed only for a physical separation of the crude, cracking reactions can occur, which would produce deleterious olefins. Cracking reactions, however, can be minimized and accordingly, the distillation should be carried out at conditions which produce a minimum of cracking. For example, cracking reactions are a function of the residence time at high temperatures, and a properly designed unit will minimize liquid residence time at the high temperature points of the pipe still. The pipe still operator can also limit the flash zone temperature on the unit to limit cracking reactions. The virgin cut from the distillation can then be caustic treated to remove deleterious carboxylic acids, phenols and amides and then water washed.

The water washed product then can be given a controlled catalytic treatment with hydrogen. Such a process, for example, could be a hydrotreating (hydrofining) process where a cobalt-molybdate type catalyst is used at elevated temperatures and pressures with added hydrogen, for example, at 500° to 700° F., 200 to 800 psig and with hydrogen consumption rates of 10 to 1,000 SCF per barrel. This type of controlled catalytic treatment removes peroxides, hydroperoxides, reactive olefins and sulfur compounds from the classes of mercaptans and sufides, plus any disulfides or polysulfides which may be present, but does not remove dibenzothiophene type sulfur compounds. The rate of removal of sulfur from compound classes such as condensed thiophene compounds is much slower than the rate of removal of sulfur from compound classes such as sulfides, mercaptans, disulfides and polysulfides, and thus the dibenzothiophenes which have been found to improve thermal stability can be left in the hydrocarbon blend by careful adjustment of the catalytic process conditions.

Removal of deleterious alkylpyridines during this catalytic treatment, however, may not be effected since the rate of denitrogenation is generally slower than that of desulfurization. Alkylpyridine removal can be effected by a controlled acid washing step, followed by a water wash and redistillation of the product. This acid washing step may remove additional olefins and will also remove paraffinic amines and piperidines, which are more basic than pyridines. The acid washing step, however, can be controlled to leave behind pyrrolic compounds which are less basic than pyridines and which have been found to improve thermal stability. Paraffinic amines and piperidines, and additional dibenzothiophenes and dibenzopyrroles if needed, can then be added to the product.

As the last step, molecular oxygen ($O_2$) is removed from the blend by bubbling the liquid with an oxygen free inert gas such as nitrogen or helium, and stored in closed containers under a similar oxygen free atmosphere.

Although the overall procedure just described can be used to prepare the blends of this invention, it will be apparent to those of ordinary skill in the art that there are many other routes which can be followed to achieve the desired removals and additions of compounds in accordance with the present invention. For example, instead of subjecting the fuel to a hydrotreating catalytic treatment, a hydroconversion (hydrocracking) process can be used. Hydrocracking is basically a combination of catalytic cracking and hydrogenation and employs operating conditions that are more severe than with hydrotreating. Thus, hydroconversion processes usually employ temperatures of from 600° to 800° F., pressure from 800 to 3000 psig and hydrogen consumption rates from 200 to 1000 SCF of $H_2$ per barrel. Products from hydrocracking processes have negligible sulfur, nitrogen, and olefin content because of the use of high pressure hydrogen treatment.

Where the jet fuel blends of the invention are treated only by removing deleterious trace compounds, the blends preferably have a composition comprising 5 to 50% by volume aromatics, preferably 10 to 25%; 25 to 70% by volume paraffins, preferably 30 to 60%; and 25 to 70% cycloparaffins, preferably 30 to 60%. Both mono-ring and condensed ring compounds are included in the cycloparaffin and aromatic classes of compounds. The additives which have been used to bring about improved thermal stability can be added to any jet fuel composition.

Although the invention has been described with specific reference to jet fuels, it is applicable to a wide variety of liquid hydrocarbon blends having carbon numbers of from $C_4$ to $C_{25}$ including hydraulic fluids, lubricating oils, transformer oils, kerosene products, hydrocarbon rocket fuels, hydrocarbon based heat transfer fluids, diesel engine fuels, motor and aviation gasoline, and fuel and oils for ground based turbines. These blends as will be apparent to those skilled in the art can be deoxygenated and processed to remove the deleterious nitrogen, organic oxygen containing, and sulfur compounds and olefins described above and to have the beneficial dibenzothiophenes and nitrogen compounds added thereto.

The invention in its broader aspects is not limited to the specific details shown and described and departures may be made from such details without departing from the principles of the invention and without sacrificing its chief advantages.

What is claimed is:

1. A blend of hydrocarbon compounds containing less than 15 ppm by weight dissolved molecular oxygen; less than 10 ppm by weight sulfur in the form of an organic sulfur compound classed as a thiol, sulfide, disulfide or polysulfide; less than 10 ppm by weight oxygen in the form of an organic oxygen compound classed as a peroxide or hydroperoxide, and less than 0.20% (vol.) of reactive olefins and containing a dibenzothiophene compound selected from the group consisting of dibenzothiophene and the alkyl substituted dibenzothiophenes containing 1 to 8 alkyl groups, the alkyl groups containing from 1 to 4 carbon atoms to improve the thermal stability thereof with the total number of carbon atoms in the compound being no greater than 22.

2. The blend of claim 1 wherein the dibenzothiophene compound is dibenzothiophene.

3. The blend of claim 1 containing from about 0.1 to 1.0 wt. percent of a dibenzothiophene compound.

4. The blend of claim 1 wherein the dibenzothiophene compound is an alkyl substituted dibenzothiophene.

5. The blend of claim 1 wherein the hydrocarbon compounds having a boiling point range of 100° to 600° F.

6. The blend of claim 1 wherein the hydrocarbon compounds have a boiling point range of 300° to 550° F.

7. A blend of hydrocarbon compounds containing less than 15 ppm by weight dissolved molecular oxygen; less than 10 ppm by weight sulfur in the form of an organic sulfur compound classed as a thiol, sulfide, disulfide or polysulfide; less than 10 ppm by weight oxygen in the form of an organic oxygen compound classed as a peroxide or hydroperoxide, and less than 0.20% (vol.) of reactive olefins and containing an organic nitrogen compound selected from the group consisting of the paraffinic amines, having the general formula $RNH_2$ where R is an alkyl group having 1 to 22 carbon atoms, the carbazoles having the general formula

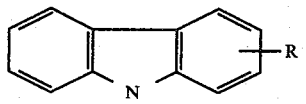

where R can be one or more hydrogen radicals or one or more alkyl groups having from 1 to 12 carbon atoms in each group, with the total number of carbon atoms in the alkyl groups being no greater than 12 and the piperidines having the general formula

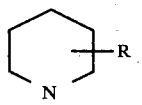

where R is one or more hydrogen radicals or one or more alkyl groups having 1 to 18 carbon atoms in each group, with the total number of carbon atoms in the alkyl groups being not greater than 18 to improve the thermal stability thereof.

8. The blend of claim 7 wherein said organic nitrogen compound provides from about 10 to 1000 ppm nitrogen.

9. The blend of claim 7 containing a dibenzothiophene compound selected from the group consisting of dibenzothiophene and alkyl substituted dibenzothiophenes containing 1 to 8 alkyl groups, the alkyl groups containing from 1 to 4 carbon atoms to improve the thermal stability thereof with the total number of carbon atoms in the compound being no greater than 22.

10. The blend of claim 7 wherein the hydrocarbon compounds have a boiling point range of 100° to 600° F.

11. The blend of claim 7 wherein the hydrocarbon compounds have a boiling point range of 300° to 550° F.

12. A blend of hydrocarbon compounds having improved thermal stability containing: less than 15 ppm dissolved molecular oxygen; less than 10 ppm by weight sulfur in the form of an organic sulfur compound classed as a thiol, sulfide, disulfide, or polysulfide; less than 10 ppm oxygen in the form of an oxygen compound classed as a peroxide, hydroperoxide, paraffinic carboxylic acid, phenol or amide; less than 5 ppm by weight nitrogen in the form of an organic nitrogen compound classed as an amide or an alkyl-pyridine; and less than 0.20% (vol.) of a reactive olefin and containing a dibenzothiophene compound selected from the group consisting of dibenzothiophene and the alkyl substituted dibenzothiophenes containing 1 to 8 alkyl groups, the alkyl groups containing from 1 to 4 carbon atoms to improve the thermal stability thereof with the total number of carbon atoms in the compound being no greater than 22.

13. The blend of claim 12 wherein the hydrocarbon compounds have a boiling point range of 100° to 600° F.

14. The blend of claim 12 wherein the hydrocarbon compounds have a boiling point range of 300° to 550° F.

15. A blend of hydrocarbon compounds having improved thermal stability containing: less than 15 ppm dissolved molecular oxygen: less than 10 ppm by weight sulfur in the form of an organic sulfur compound classed as a thiol, sulfide, disulfide, or polysulfide; less than 10 ppm oxygen in the form of an oxygen compound classed as a peroxide, hydroperoxide, paraffinic carboxylic acid, phenol or amide; less than 5 ppm by weight nitrogen in the form of an organic nitrogen compound classed as an amide or an alkyl pyridine; and less than 0.20% (vol.) of a reactive olefin and containing an organic nitrogen compound selected from the group consisting of the paraffinic amines, having the general formula $RNH_2$ where R is an alkyl group having 1 to 22 carbon atoms, the carbazoles having the general formula

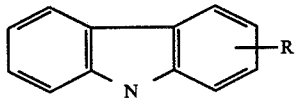

where R can be one or more hydrogen radicals or one or more alkyl groups having from 1 to 12 carbon atoms in each group, with the total number of carbon atoms in the alkyl groups being no greater than 12 and the piperidines having the general formula

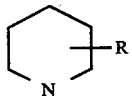

where R is one or more hydrogen radicals or one or more alkyl groups having 1 to 18 carbon atoms in each group, with the total number of carbon atoms in the alkyl groups being not greater than 18 to improve the thermal stability thereof.

16. The blend of claim 15 containing a dibenzothiophene compound to improve the thermal stability thereof.

17. The blend of claim 15 wherein the hydrocarbon compounds have a boiling point range of 100° to 600° F.

18. The blend of claim 15 wherein the hydrocarbon compounds have a boiling point range of 300° to 550° F.

* * * * *